US009257216B2

(12) United States Patent
Odahara

(10) Patent No.: US 9,257,216 B2
(45) Date of Patent: Feb. 9, 2016

(54) METAL POWDER AND ELECTRONIC COMPONENT

(71) Applicant: MURATA MANUFACTURING CO., LTD., Kyoto (JP)

(72) Inventor: Mitsuru Odahara, Kyoto-fu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 147 days.

(21) Appl. No.: 14/084,387

(22) Filed: Nov. 19, 2013

(65) Prior Publication Data

US 2014/0070916 A1 Mar. 13, 2014

Related U.S. Application Data

(63) Continuation of application No. PCT/JP2012/075549, filed on Oct. 2, 2012.

(30) Foreign Application Priority Data

Oct. 14, 2011 (JP) ..... 2011-226471

(51) Int. Cl.

| | |
|---|---|
| ***H01F 1/33*** | (2006.01) |
| ***H01F 1/01*** | (2006.01) |
| ***H01F 1/09*** | (2006.01) |
| ***B22F 1/02*** | (2006.01) |
| ***H01F 1/26*** | (2006.01) |
| *H01F 17/00* | (2006.01) |

(52) U.S. Cl.

CPC .. *H01F 1/01* (2013.01); *B22F 1/02* (2013.01); *B22F 1/025* (2013.01); *H01F 1/09* (2013.01); *H01F 1/26* (2013.01); *H01F 1/33* (2013.01); *C22C 2202/02* (2013.01); *H01F 17/0013* (2013.01)

(58) Field of Classification Search

CPC ..... H01F 1/33; H01F 1/09; H01F 17/0013; B22F 1/02

See application file for complete search history.

(56) References Cited

U.S. PATENT DOCUMENTS

2006/0152321 A1 7/2006 Jung et al.

FOREIGN PATENT DOCUMENTS

| | | | |
|---|---|---|---|
| JP | 56-38402 | * | 4/1981 |
| JP | 56-038402 | A | 4/1981 |
| JP | 63-316412 | A | 12/1988 |
| JP | H04-352403 | A | 12/1992 |
| JP | 2001-237115 | * | 10/2001 |
| JP | 2004-238684 | A | 8/2004 |
| JP | 2004-296968 | A | 10/2004 |
| JP | 2004-297036 | * | 10/2004 |
| JP | 2004-297036 | A | 10/2004 |
| JP | 2005-068526 | A | 3/2005 |
| JP | 2005-150257 | A | 6/2005 |
| JP | 2005142514 | A | 6/2005 |
| JP | 2005-311078 | A | 11/2005 |
| JP | 2006-077294 | A | 3/2006 |
| JP | 2006-190948 | A | 7/2006 |
| JP | 2009-010268 | A | 1/2009 |
| JP | 2010-092989 | A | 4/2010 |

OTHER PUBLICATIONS

Translation for JP 2001-237115, Aug. 31, 2001.*

Igarashi et al, "Zn-Ferrite-Coated Iron Powder Prepared through Oxidation Process and Zn Vapor Deposition Process", Abstracts of Meeting of Japan Society of POwder and POwder Metallurgy, Spring 2004, p. 118.*

Translation for JP 2004-297036, Oct. 21, 2004.*

An Office Action; "Decision of Final Rejection," issued by the Japanese Patent Office on Dec. 9, 2014, which corresponds to Japanese Patent Application No. 2013-538504 and is related to U.S. Appl. No. 14/084,387; with English language translation.

An Office Action; "Notification of Reasons for Refusal," issued by the Japanese Patent Office on Mar. 4, 2014, which corresponds to Japanese Patent Application No. 2013-538504 and is related to U.S. Appl. No. 14/084,387; with English language translation.

Meilan Wen, et al.; "Magnetic, electronic and structural properties of ZnxFe3—xO4"; Journal of Electron Spectroscopy and Related Phenomena; Oct. 2006; pp. 65-70; vol. 153, Issue 153; Elsevier.

International Search Report; PCT/JP2012/075549; Oct. 30, 2012.

Written Opinion of the International Searching Authority; PCT/JP2012/075549; Oct. 30, 2012.

K. Igarashi et al,; "Zn-Ferrite-Coated Iron Powder Prepared through Oxidation Process and Zn Vapor Deposition Process"; Abstracts of Spring Meeting of Japan Society of Powder and Powder Metallurgy; 2004; pp. 118.

An Office Action issued by the Chinese Patent Office on Nov. 27, 2015, which corresponds to Chinese Patent Application No. 201280025952.8 and is related to U.S Appl. No. 14/084,387; with English language translation.

* cited by examiner

*Primary Examiner* — Carol M Koslow

(74) *Attorney, Agent, or Firm* — Studebaker & Brackett PC

(57) ABSTRACT

Metal powder has composite particles each coated with a Zn-based ferrite film not containing Ni.

7 Claims, 7 Drawing Sheets

METAL POWDER AND ELECTRONIC COMPONENT

CROSS REFERENCE TO RELATED APPLICATIONS

The present application is a continuation of International Application No. PCT/JP2012/075549 filed on Oct. 2, 2012, and claims priority to Japanese Patent Application No. 2011-226 filed on Apr. 27, 2011, the contents of each of these applications being incorporated herein by reference in their entirety.

TECHNICAL FIELD

The technical field relates to metal powder and an electronic component, and more particularly to metal powder comprising composite particles that are obtained by subjecting the surfaces of metal particles to an insulating treatment, and an electronic component employing the same.

BACKGROUND

As conventional metal powder, for example, composite magnetic particles disclosed by Japanese Patent Laid-Open Publication No. 2005-150257 are known. The composite magnetic particles are obtained by coating each metal magnetic particle with Ni—Zn ferrite. The surfaces of metal particles are subjected to an insulating treatment in this way, whereby the composite magnetic particles are obtained.

The inventors, however, found out that with regard to the composite magnetic particles disclosed by Japanese Patent Laid-Open Publication No. 2005-150257, not all the metal magnetic particles are satisfactorily coated with Ni—Zn ferrite.

SUMMARY

The present disclosure provides metal powder comprising metal particles, each coated with a film having high coatability, and an electronic component employing the same.

Metal powder according to an embodiment includes composite particles that are metal particles each coated with a Zn-based ferrite film not containing Ni.

In a more specific embodiment, the metal particles may be metal magnetic particles.

An electronic component according to an embodiment of the present invention comprises a body containing the metal powder, and an inductor provided in/on the body.

BRIEF DESCRIPTION OF THE DRAWINGS

This and other features of the present disclosure will be apparent from the following description with reference to the accompanying drawings, which are now briefly described.

DETAILED DESCRIPTION

Metal powder and an electronic component according to some embodiments of the present disclosure will be hereinafter described with reference to the accompanying drawings.

Figure 1:
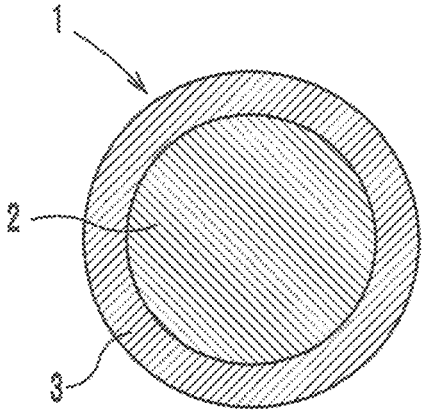
FIG. 1 is a sectional view of a composite particle comprised in metal powder according to a first exemplary embodiment.

Metal powder according to a first exemplary embodiment of the present disclosure is described with reference to the accompanying drawings. FIG. 1 is a sectional view of a composite particle 1 comprised in the metal powder according to the first embodiment.

The metal powder comprises composite particles 1, each of which is an Ag particle 2 coated with a Zn-based ferrite film 3 as shown by FIG. 1. The diameter of the Ag particle 2 is, for example, approximately 10 μm. The Zn-based ferrite film 3 is insulating ferrite, for example, having a composition shown as $Zn_xFe_{3-x}O_4$, and is essentially free of Ni. As used herein, a Zn-based ferrite film that is "essentially free of Ni" relates to a Zn-based ferrite film that does not contain Ni, or, as traces of Ni exist in many materials, a Zn-based ferrite film with at most as little Ni as possible according to material availability and limitations of detection by the prevailing analytic methods. The "x" in the composition formula is equal to or greater than 0.15 and less than 1.

The metal powder is prepared through the following processes.

First, metal powder comprising Ag particles 2 with a diameter of 10 μm is prepared.

Next, on the surfaces of the Ag particles 2, Zn-based ferrite films 3 are formed by ferrite plating. More specifically, a water solution of $FeCl_2.4H_2O$ and a water solution of $ZnCl_2$ are mixed together at a predetermined ratio, so that a reaction liquid containing $Fe^{2+}$ and $Zn^{2+}$ results. In this moment, in order to prevent the reaction liquid from oxidization, $N_2$-gas bubbling is carried out.

Next, the metal powder comprising the Ag particles 2 and a pH adjuster (for example, KOH) are put into a plating bath, and the reaction liquid is dropped at an approximately constant rate. Exemplary conditions of the ferrite plating are as follows. Under the conditions, Zn-based ferrite films 3 with a thickness of 0.3 μm are formed.

pH: 8.5 (approx.)

Temperature of the liquid: 60 degrees C. (approx.)

Rate of dropping: 5 mL/min (approx.)

Plating time: 60 minutes (approx.)

Through the processes above, the metal powder according to the embodiment is prepared.

The metal powder as described above comprises Ag particles 2 each coated with a Zn-based ferrite film 3, and the coating ability of the ferrite film 3 is higher than the coatability of the ferrite film on each of the composite particles disclosed by Japanese Patent Laid-Open Publication No. 2005-150257. More specifically, as mentioned, a reaction liquid that contains $Fe^{2+}$ and $Zn^{2+}$, etc. is used for the ferrite plating. Herein, if the reaction liquid contains a large amount of metal ions other than $Fe^{2+}$, adsorption and precipitation of $Fe^{2+}$ on the Ag particles 2 will be obstructed. In this embodiment, therefore, the Ag particles 2 are coated with Zn-based ferrite films 3 that do not contain Ni. Thus, the reaction liquid does not contain $Ni^{2+}$, and accordingly, $Fe^{2+}$ readily adsorbs and/or precipitates on the Ag particles 2. Therefore, the ferrite-film coatability of the metal powder according to this embodiment is higher than that of the composite particles disclosed by Japanese Patent Laid-Open Publication No. 2005-150257.

In order to prove the advantageous effects of the metal powder according to this embodiment, the inventors conducted an experiment as follows. Specifically, a first to a fourth sample were fabricated while the ratio of $Fe^{2+}$, $Zn^{2+}$ and $Ni^{2+}$ to each other in the reaction liquid was varied. Table 1 shows the ratio of $Fe^{2+}$, $Zn^{2+}$ and $Ni^{2+}$ to each other in the reaction liquid that was used for fabrication of each of the first to fourth samples.

TABLE 1

| | Sample 1 | Sample 2 | Sample 3 | Sample 4 |
|---|---|---|---|---|
| $Fe^{2+}$ | 120 mM | 120 mM | 240 mM | 240 mM |
| $Zn^{2+}$ | — | 10 mM | 10 mM | 10 mM |
| $Ni^{2+}$ | — | — | — | 75 mM |

M: mol/L

The compositions of the first to fourth samples were analyzed by FE-WDX (with a device JXA-8500 made by JEOL Ltd.). The analysis was conducted under the conditions that the accelerating voltage was 15 kV, that the irradiation current was 50 nA and that the probe diameter was set to "focused". The analysis results are shown below.

First sample: could not measured

Second sample: $Zn_{0.33}Fe_{2.67}O_4$

Third sample: $Zn_{0.15}Fe_{2.85}O_4$

Fourth sample: $Zn_{0.17}Ni_{0.53}Fe_{2.31}O_4$

Figure 2:
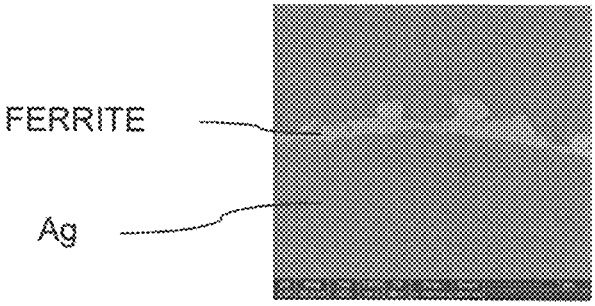
FIG. 2 is a photograph of a section of a second sample.
Figure 3:
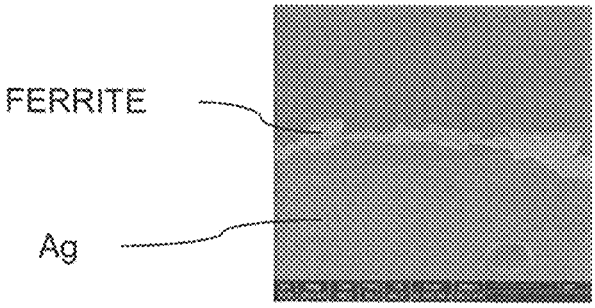
FIG. 3 is a photograph of a section of a third sample.
Figure 4:
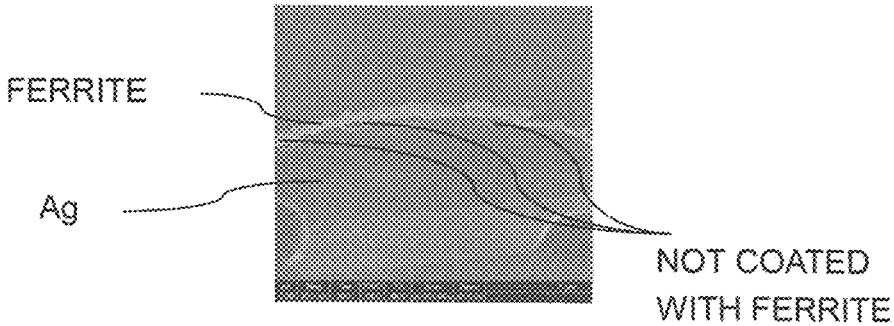
FIG. 4 is a photograph of a section of a fourth sample.

Further, the first to fourth samples were subjected to an FIB (focused ion beam) treatment by use of an FIB device (FIB200TEM made by FEI Company), and thereafter, the sections of the samples were observed by use of a SIM (scanning ion microscope). FIGS. 2 to 4 are photographs of the sections of the second to fourth samples. With regard to the first sample, there was hardly any ferrite film formed because the reaction liquid did not contain $Zn^{2+}$. Therefore, here is no photograph of the first sample presented.

With regard to the fourth sample that was fabricated by use of a reaction liquid containing $Ni^{2+}$, as shown by FIG. 4, portions uncoated with a ferrite film were seen on the surface of the Ag particle. With regard to the second and third samples that were fabricated by reaction liquids not containing $Ni^{2+}$, as shown by FIGS. 2 and 3, the surfaces of the Ag particles 2 are entirely coated with ferrite films. The experiment results shows that the Zn-based ferrite films 3 that were formed by use of reaction liquids not containing $Ni^{2+}$ have higher coating abilities than the Ni—Zn based ferrite film that was formed by use of a reaction liquid containing $Ni^{2+}$.

Figure 5:
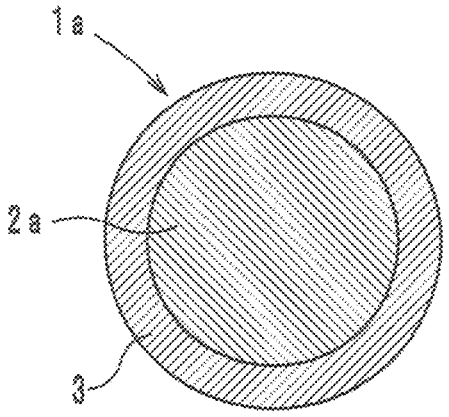
FIG. 5 is a sectional view of a composite particle comprised in metal powder according to a second exemplary embodiment.

In the following, metal powder according to a second exemplary embodiment is described with reference to the accompanying drawings. FIG. 5 is a sectional view of a composite particle 1*a* comprised in the metal powder according to the second embodiment.

The composite particle 1*a* comprises a permalloy particle 2*a* instead of the Ag particle 2 of the composite particle 1. The permalloy particle 2*a* is a particle made of an alloy of Fe and Ni, and is a metal magnetic particle. The other parts of the composite particle 1*a* are the same as those of the composite particle 1, and descriptions thereof are provided above and not repeated here. The method for preparing the metal powder according to the second embodiment is the same as the method for preparing the metal powder according to the first embodiment, and a description of the preparation method can be inferred from the above description.

Figure 6:
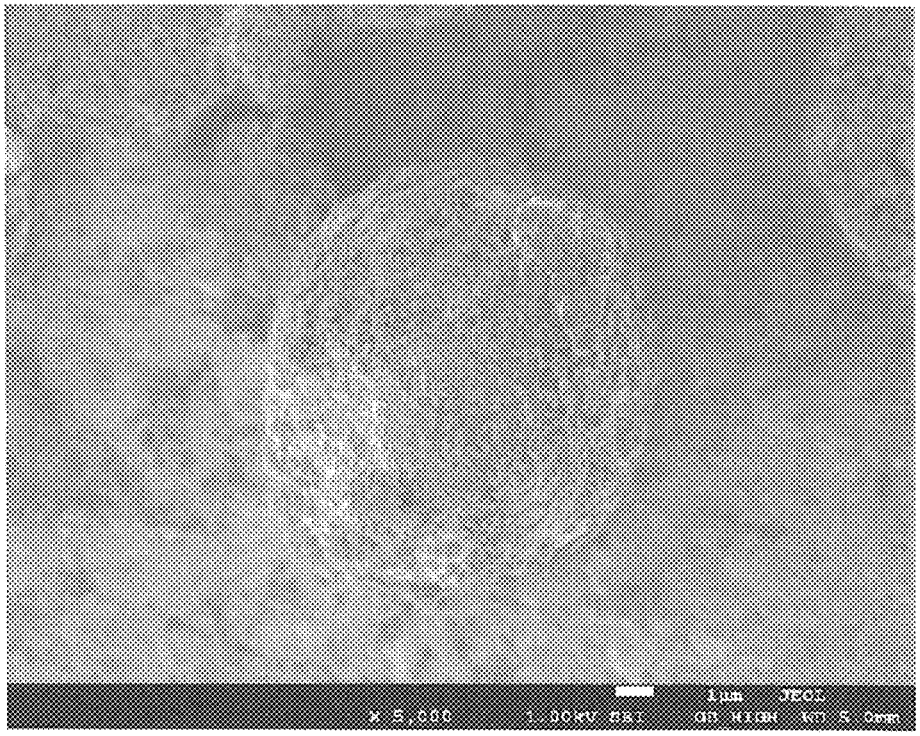
FIG. 6 is an SEM photograph of the metal powder according to the second embodiment.

Like the metal powder according to the first embodiment, the ferrite-film coating ability of the metal powder according to the second embodiment is higher than the ferrite-film coatability of the composite magnetic particles disclosed by Japanese Patent Laid-Open Publication No. 2005-150257. FIG. 6 is an SEM photograph of the metal powder according to the second embodiment. As shown by FIG. 6, the permalloy particle 2*a* is satisfactorily coated with a Zn-based ferrite film 3.

Also, use of the metal powder according to the second embodiment allows production of an electronic component incorporating an inductor, such as a coil, with a high inductance value and a desired DC-superposing characteristic. More specifically, permalloy and other metal magnetic materials have characteristics of having a high magnetic permeability and of causing less magnetic saturation.

However, since such metal magnetic materials are conductive, it is impossible to use these materials, for example, for a body of an inductor, as it is.

For this reason, according to the second embodiment, the permalloy particles 2*a* are coated with Zn-based ferrite films 3, whereby insulated composite particles 1*a* are obtained. Consequently, the metal powder according to the second embodiment can be used as a material for a body of an inductor. Thus, by using the metal powder according to the second embodiment, it is possible to obtain an electronic component having a high inductance value and having a desired DC-superposing characteristic.

In the metal powder according to the second embodiment, the Zn-based ferrite films 3 may be covered by Ni—Zn ferrite layers. Although it is difficult to form a Ni—Zn ferrite layer on the surface of a permalloy particle 2*a* at high coating ability, it is relatively easy to form a Ni—Zn ferrite layer on Zn-based ferrite. With the Ni—Zn ferrite layers, the metal powder according to the second embodiment has higher insulation properties.

Figure 7:
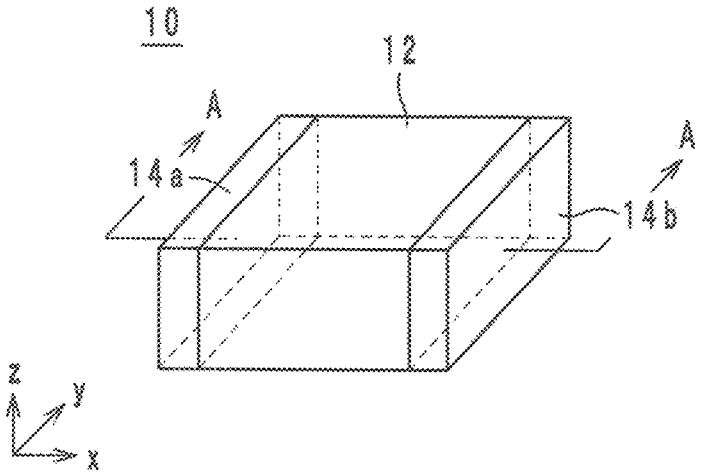
FIG. 7 is a perspective view of an electronic component according to an exemplary embodiment.
Figure 8:
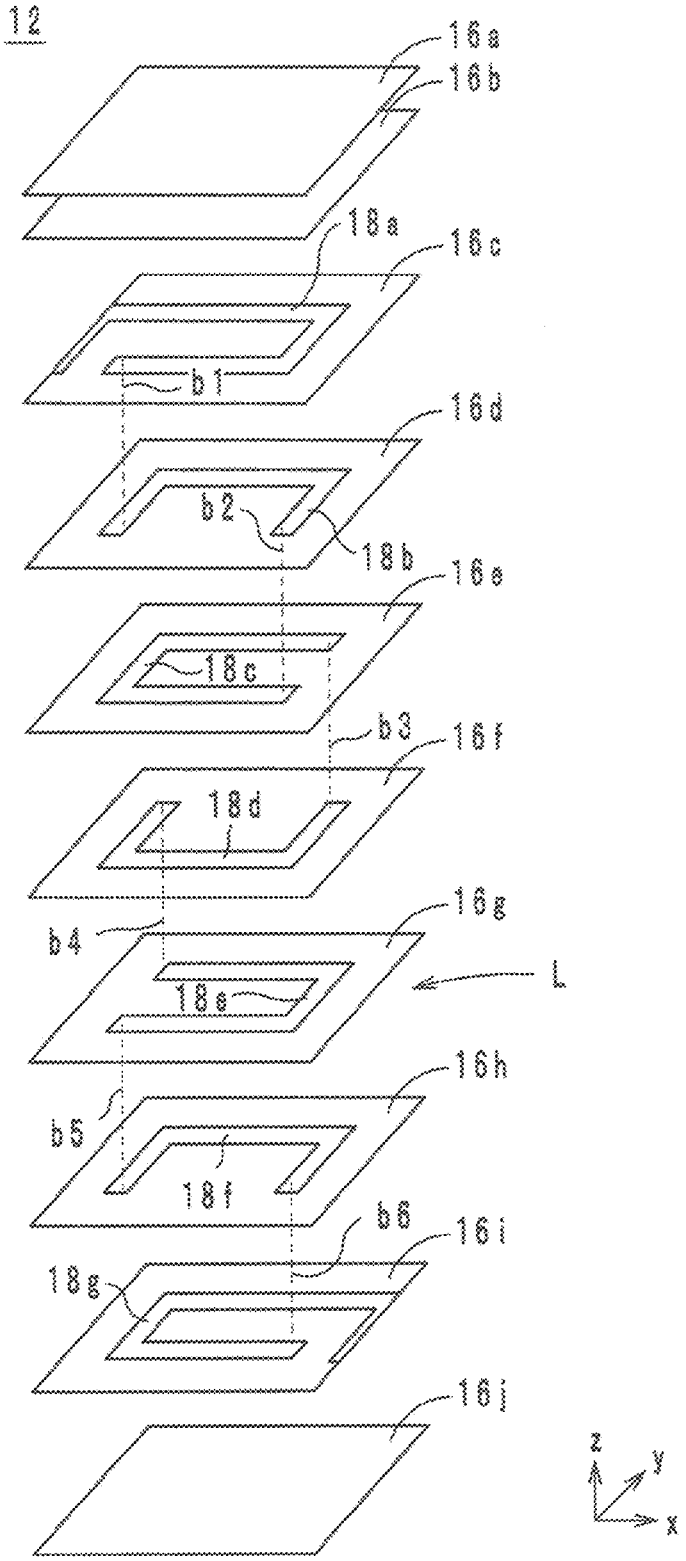
FIG. 8 is an exploded perspective view of the electronic component according to the embodiment shown in FIG. 7.
Figure 9:
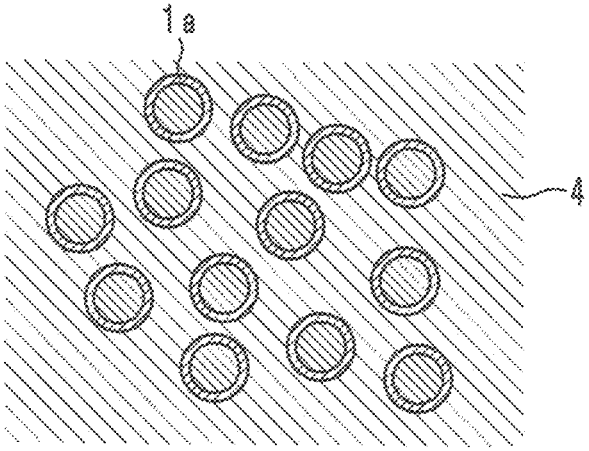
FIG. 9 is an enlarged view of an insulating layer comprised in a laminated body of the electronic component.

Next, an exemplary electronic component made by using the metal powder according to the second embodiment is described with reference to the accompanying drawings. FIG. 7 is a perspective view of the electronic component 10 according to an exemplary embodiment. FIG. 8 is an exploded perspective view of a laminated body 12 of the electronic component 10. FIG. 9 is an enlarged view of an insulating layer 16 comprised in the laminated body 12 of the electronic component 10.

A layer-stacking direction of the electronic component 10 is defined as a z-axis direction. Directions along two sides of a top surface of the electronic component 10 that is located at a positive side with respect to the z-axis direction are defined as an x-axis direction and a y-axis direction, respectively. The x-axis direction, y-axis direction and z-axis direction are perpendicular to each other.

The electronic component 10, as shown by FIGS. 7 and 8, comprises a laminated body (main body) 12, external electrodes 14 (14*a*, 14*b*) and an inductor L.

The laminated body 12 is in the shape of a rectangular parallelepiped, and incorporates an inductor L. In the following paragraphs, the surface of the laminated body 12 that is located at a positive side with respect to the z-axis direction is referred to as a top surface, and the surface of the laminated body 12 that is located at a negative side with respect to the z-axis direction is referred to as a bottom surface. The other surfaces of the laminated body 12 are referred to as side surfaces.

The laminated body 12, as shown by FIG. 8, is formed by stacking insulating layers 16 (16*a* to 16*j*) in this order from the positive side to the negative side along the z-axis direction. The insulating layers 16 are made of a mixture of the metal powder according to the second embodiment and a ferrite magnetic material 4 as shown by FIG. 9, that is, the laminated body 12 is made of the mixture. The metal powder according to the second embodiment is dispersed in the sintered ferrite magnetic material 4. In the following, a surface of each of the insulating layers 16 that is located at the positive side with respect to the z-axis direction is referred to as a front side, and a surface of each of the insulating layers 16 that is located at the negative side with respect to the z-axis direction is referred to as a back side.

The external electrode 14*a*, as shown in FIG. 7, is provided to cover a side surface of the laminated body 12 that is located at a negative side with respect to the x-axis direction. The external electrode 14*b*, as shown in FIG. 7, is provided to cover a side surface of the laminated body 12 that is located at a positive side with respect to the x-axis direction. The external electrodes 14*a* and 14*b* are folded back to the top surface, the bottom surface, the side surface that is located at the positive side with respect to the y-axis direction and the side surface that is located at the negative side with respect to the y-axis direction. The external electrodes 14*a* and 14*b* function as connection terminals to electrically connect the inductor L to a circuit outside of the electronic component 10.

The inductor L is typically a coil and is embedded in the laminated body 12. Alternatively, the inductor L can be, for example, a meander inductor or a linear inductor. Further, the inductor L can be mounted on the laminate body 12. As shown by FIG. 8, the inductor L comprises pattern conductors 18 (18*a* to 18*g*) and via-hole conductors b1 to b6. The pattern conductors 18 and the via-hole conductors b1 to b6 are connected, whereby the inductor L (i.e., the coil) is formed into a helical shape.

The pattern conductors 18*a* to 18*g*, as shown in FIG. 8, are provided on the front surfaces of the respective insulating layers 16*c* to 16*i*, and each of the pattern conductors 18*a* to 18*g* is such a U-shaped linear conductor as to form into a helical shape that turns clockwise when viewed from the positive side with respect to the z-axis direction. The pattern conductors 18*a* to 18*g* are overlapped with each other to form into a rectangular loop when viewed from the z-axis direction. More specifically, each of the pattern conductors 18*a* to 18*g* makes ¾ turns, that is, extends along three sides of the corresponding insulating layers 16*c* to 16*i*. The pattern conductor 18*a* is provided on the insulating layer 16*c* and extends along the three sides other than the shorter side at the negative side with respect to the x-axis direction. Also, the pattern conductor 18*a* is led to the shorter side of the insulating layer 16*c* at the negative side with respect to the x-axis direction, so that the pattern conductor 18*a* is connected to the external electrode 14*a*. The pattern conductor 18*b* is provided on the insulating layer 16*d* and extends along the three sides other than the longer side at the negative side with respect to the y-axis direction. The pattern conductor 18*c* is provided on the insulating layer 16*e* and extends along the three sides other than the shorter side at the positive side with respect to the x-axis direction. The pattern conductor 18*d* is provided on the insulating layer 16*f* and extends along the three sides other than the longer side at the positive side with respect to the y-axis direction. The pattern conductor 18*e* is provided on the insulating layer 16*g* and extends along the three sides other than the shorter side at the negative side with respect to the x-axis direction. The pattern conductor 18*f* is provided on the insulating layer 16*h* and extends along the three sides other than the longer side at the negative side with respect to the y-axis direction. The pattern conductor 18*g* is provided on the insulating layer 16*i* and extends along the three sides other than the shorter side at the positive side with respect to the x-axis direction. The pattern conductor 18*g* is led to the shorter side of the insulating layer 16*i* at the positive side with respect to the x-axis direction, so that the pattern conductor 18*g* is connected to the external electrode 14*b*.

In the following, the upstream end and the downstream end of each of the pattern conductors 18 with respect to the clockwise helical direction when viewed from the positive side with respect to the z-axis direction is referred to as an upstream end and a downstream end, respectively. Each of the pattern conductors 18 does not necessarily make ¾ turns and may make, for example, ⅞ turns.

The via-hole conductors b1 to b6, as shown in FIG. 8, are provided to pierce through the insulating layers 16*c* to 16*h* in the z-axis direction. More specifically, the via-hole conductor b1 pierces through the insulating layer 16*c* in the z-axis direction and connects the downstream end of the pattern conductor 18*a* to the upstream end of the pattern conductor 18*b*. The via-hole conductor b2 pierces through the insulating layer 16*d* in the z-axis direction and connects the downstream end of the pattern conductor 18*b* to the upstream end of the pattern conductor 18*c*. The via-hole conductor b3 pierces through the insulating layer 16*e* in the z-axis direction and connects the downstream end of the pattern conductor 18*c* to the upstream end of the pattern conductor 18*d*. The via-hole conductor b4 pierces through the insulating layer 16*f* in the z-axis direction and connects the downstream end of the pattern conductor 18*d* to the upstream end of the pattern conductor 18*e*. The via-hole conductor b5 pierces through the insulating layer 16*g* in the z-axis direction and connects the downstream end of the pattern conductor 18*e* to the upstream end of the pattern conductor 18*f*. The via-hole conductor b6 pierces through the insulating layer 16*h* in the z-axis direction and connects the downstream end of the pattern conductor 18*f* to the upstream end of the pattern conductor 18*g*.

Next, a method for manufacturing the electronic component 10 is described with reference to the drawings. Although a production method of one electronic component 10 is described in the following, actually, a plurality of laminated bodies are manufactured at one time by forming a mother laminate by stacking large-sized mother ceramic green sheets and by cutting the mother laminate into pieces.

First, ceramic green sheets to be used as the insulating layers 16 are prepared. Specifically, as raw materials, diiron trioxide ($Fe_2O_3$), zinc oxide (ZnO), nickel oxide (NiO) and cupper oxide (CuO) at a predetermined ratio are put into a ball mill and are wet-mixed. The obtained mixture is dried and crushed, whereby powder is obtained. The obtained powder is calcined at approximately 800 degrees C. for about one hour. The obtained calcined powder is wet-crushed, dried and cracked, whereby ferrite ceramic powder is obtained.

Also, the metal powder according to the second embodiment is prepared. A method for preparing the metal powder according to the second embodiment was described above, and the method is not described here.

Next, a binder, such as vinyl acetate or water-soluble acrylic, a plasticizer, a wet material and a dispersant are added to the metal powder and the ferrite ceramic powder, and these materials are mixed in a ball mill. Thereafter, the mixture is defoamed by decompression, whereby ceramic slurry is obtained. The obtained ceramic slurry is spread on a carrier sheet by a doctor blade method, whereby the ceramic slurry is formed into a sheet. The sheet is dried, and thus, a ceramic green sheet to be used as the insulating layer 16 is obtained.

Next, the via-hole conductor b1 to b6 are formed in the respective ceramic green sheets to be used as the insulating layers 16*c* to 16*h*. Specifically, the ceramic green sheets to be used as the insulating layers 16*c* to 16*h* are irradiated with a laser beam, whereby via-holes are made in the ceramic green sheets. Next, paste of a conductive material, such as Ag, Pd, Cu, Au or an alloy of these materials, is filled in the via-holes by printing application or the like, whereby the via-hole conductors b1 to b6 are formed.

Next, paste of a conductive material is applied on the ceramic green sheets to be used as the insulating layers 16*c* to 16*i* by screen printing, whereby the pattern conductors 18*a* to 18*g* are formed. The conductive material is prepared, for example, by adding a varnish and a solvent to Ag.

The formation of the pattern conductors 18 and the filling of the conductive paste in the via-holes can be performed in the same process.

Next, the ceramic green sheets to be used as the insulating layers 16 are stacked and are provisionally press-bonded one by one, whereby an unfired laminated body 12 is obtained. After stacking and provisionally press-bonding the ceramic green sheets to be used as the insulating layers 16 one by one, the laminated body 12 is permanently press-bonded by isostatic pressing.

Next, the unfired laminated body 12 is subjected to a binder-removing treatment and firing. The binder-removing treatment is carried out, for example, under hypoxic atmosphere at approximately 500 degrees C. for about two hours. The firing is carried out, for example, at 850 degrees C. for two hours and a half. Thereafter, the laminated body 12 is subjected to barrel polishing and chamfering.

Next, electrode paste made of an Ag-based conductive material is applied to the side surfaces of the laminated body 12 that are located at both ends with respect to the x-axis direction. The applied electrode paste is baked at approximately 800 degrees C. for one hour. Thereby, silver electrodes to be used as the external electrodes 14 are formed. Further, Ni and Sn are sequentially plated on the surfaces of the silver electrodes, whereby the external electrodes 14 are formed. Through the processes above, the electronic component 10 is produced.

Figure 10:
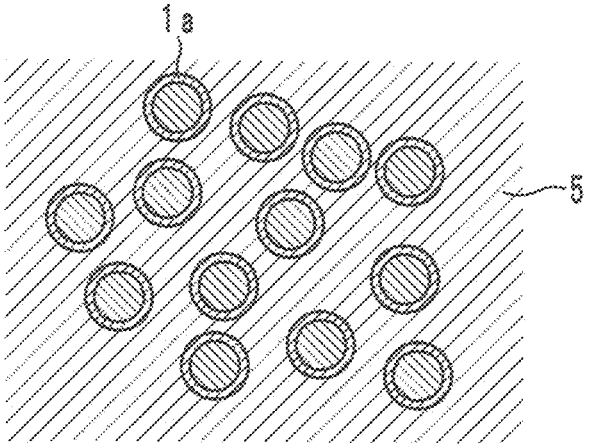
FIG. 10 is an enlarged view of an insulating layer made of a mixture of the metal powder and glass.

The laminated body 12 of the electronic component 10 is made of a mixture of the metal powder and ferrite ceramic powder. The laminated body 12 may be made of, for example, a mixture of the metal powder and glass or a mixture of the metal powder and resin. FIG. 10 is an enlarged view of an insulating layer 16 made of a mixture of the metal powder and glass. As shown by FIG. 10, the composite particles 1*a* of the metal powder are dispersed in glass 5, which was melted and solidified. In such a structure, the glass or the resin is insulating. Therefore, even if the Zn-based ferrite films 3 of the composite particles 1*a* come off from the permalloy particles 2*a*, short circuit among the composite particles 1*a* is less likely to occur because of the existence of glass or resin among the composite particles 1*a*.

The metal powder according to the second embodiment can be used for a molded coil. The molded coil is an inductor that has an air-cored coil enclosed in a magnetic molded resin made of the metal powder and resin kneaded together.

As described above, in the metal powder according to the embodiments, metal particles are coated with films having high coating ability.

What is claimed is:

1. Metal powder comprising:

composite particles that are metal magnetic particles each coated with a Zn-based ferrite film essentially free of Ni, the Zn-based ferrite film being coated with a Ni—Zn ferrite film.

2. The metal powder according to claim 1, wherein the Zn-based ferrite film is formed on a surface of each of the metal magnetic particles by plating, the metal magnetic particles being permalloy particles.

3. The metal powder according to claim 1, wherein the Zn-based ferrite film is insulating ferrite having a composition shown as $Zn_xFe_{3-x}O_4$, wherein x is equal to or greater than 0.15 and less than 1.

4. The metal powder according to claim 1, wherein the Zn-based ferrite film does not contain Ni.

5. An electronic component comprising:

a body containing a metal powder, the metal powder comprising composite particles that are metal magnetic particles each coated with a Zn-based ferrite film essentially free of Ni, the Zn-based ferrite film being coated with a Ni—Zn ferrite film; and an inductor provided in or on the body.

6. The electronic component according to claim 5, wherein the body is made of a mixture of the metal powder and a ferrite magnetic material.

7. The electronic component according to claim 5, wherein the body is made of a mixture of the metal powder and glass, or a mixture of the metal powder and resin.

* * * * *